United States Patent [19]

Kelly

[11] 4,044,559

[45] Aug. 30, 1977

[54] ROTARY CLOSED SERIES CYCLE ENGINE SYSTEM

[76] Inventor: Donald A. Kelly, 58-06 69th Place, Maspeth, N.Y. 11378

[21] Appl. No.: 423,777

[22] Filed: Dec. 11, 1973

[51] Int. Cl.[2] ..... F02G 1/04

[52] U.S. Cl. ..... 60/525; 60/517

[58] Field of Search ..... 60/517, 525, 526

[56] References Cited

U.S. PATENT DOCUMENTS

| | | | |
|---|---|---|---|
| 2,157,229 | 5/1939 | Bush | 60/521 X |
| 2,611,234 | 9/1952 | Horowitz | 60/524 X |
| 2,664,699 | 1/1954 | Kohler | 60/525 |
| 3,080,706 | 3/1963 | Flynn, Jr. et al. | 60/523 |
| 3,160,147 | 12/1964 | Hanson | 418/225 X |
| 3,459,953 | 8/1969 | Hughes | 123/119 E |
| 3,464,395 | 9/1969 | Kelly | 418/225 X |
| 3,488,945 | 1/1970 | Kelly | 60/519 |
| 3,672,341 | 6/1972 | Smith | 123/25 C |

FOREIGN PATENT DOCUMENTS

| | | | |
|---|---|---|---|
| 33,500 | 8/1924 | Denmark | 60/641 |

*Primary Examiner*—Allen M. Ostrager

[57] ABSTRACT

The rotary closed series cycle engine system is a rotary version of the latest type of series or double-acting reciprocating Stirling cycle engine. Identical rotary units are mounted in a tandem arrangement with each unit providing the displacement function for an adjacent unit, in a series gas flow loop.

Thermal transfer is greatly improved by the application of a large number of small transfer tubes in a high external loop with separation between the hot and cold sources.

Since the rotary unit has non-contacting vanes, friction is kept to a minimum while the compression ratio is moderately high.

Hydrogen gas is the fuel for the system which is obtained from an electrolysis unit with a wind generator, operating on a continuous demand controlled basis.

1 Claim, 4 Drawing Figures

SCHEMATIC

ROTARY CLOSED SERIES CYCLE ENGINE SYSTEM

BACKGROUND OF THE INVENTION

The present attractive features of the latest type of reciprocating, double-acting Stirling engine (Philips), leads to the advocacy of the double acting principle for a rotary version of this closed cycle engine design.

The reciprocating configuration does not follow the classic Stirling cycle since there is no distinct displacement function as a separate element in the present engine. The engine is double-acting in that adjacent pistons serve the displacement action for each piston in the group for alternate cooperation.

The main advantages in the reciprocating, double-acting arrangement are a highly concentrated piston/-volume density with greatly improved heat transfer through the use of a large number of small transfer tubes, with effective regeneration provision.

An additional advantage is that all pistons now produce a useful power output without the relative load losses of the previous separate displacer pistons.

The power transmission package is simplified by using a swash plate drive without a pressurized crankcase, as in the past design. A smooth power flow results from four pistons, phased ninety degrees apart with a natural balance between all the operating parts.

The use of the swash plate drive does entail large thrust vector and frictional losses which are apparently acceptable because of the several basic advantages in the configuration.

Previous rotary Stirling cycle engines have been unsuccessful due to poor heat transfer provisions and low compression ratios, in addition to power losses sustained from a separate displacer rotor. With the adoption of the series or double-acting principle and the application of a large number of small transfer tubes, as in the recip engine, it is probable that a rotary, near-counterpart of the double-acting Stirling engine will lead to a successful commercial engine system.

Although a rotary version cannot duplicate the compression ratio and distinct piston motion lag of a reciprocating engine, it will have some inherent advantages of its own, which are simplified geometric structure with reduced friction and thrust vector losses.

The inertia effect and simplified balancing with minimized drag are basic advantages, along with lower fabrication and assembly costs.

Because this rotary closed cycle engine utilizes a non-contacting vane, minimum friction rotary unit(s) it bears some relationship to the Brayton closed cycle turbine, in addition to the latest Stirling reciprocating engine design.

The current pressing need for seeking fuels other than petroleum based fuels makes the adoption of hydrogen attractive in view of its several advantages.

Decentralized, independent electrical power generating systems are highly desirable in many large cities where utility power sources have become overloaded and are currently unreliable. In addition, decentralized self-contained electrical power systems will be easier to troubleshoot, without the necessity of digging up underground feeder cables.

SUMMARY OF THE INVENTION

The rotary (Stirling) series cycle engine system consists of multiple, identical cylindrical housings with eccentrically placed vaned rotors revolving within sealed housing shells. This configuration is based on the simple Ramelli rotary pump which is now generally used in many commercial rotary pumps.

Multiple, lightweight, ball-bearing guided vanes fit into corresponding slots located within the cylindrical rotor, with the rotor shaft supported by needle bearings within the two end plates. The vane ball bearings will roll within corresponding concentric grooves within the end plates to maintain vane top clearance at a minimum consistant with an optimum compression ratio.

To produce a useful torque output at least four units or modules must be axially joined together. More than four units may be utilized, but this arrangement may complicate the burner and cooling requirements for the complete engine assembly.

Each unit or module is a nearly positive displacement expander unit which is series interconnected with adjacent modules by a large number (approximately 12) of small diameter tubing loops.

The small diameter transfer tubes run from the hot side of one engine module, diagonally across the top of the engine assembly to the cold side of an adjacent module and are connected to identically shaped hot and cold manifolds.

Since the gas flow path is uni-directional (uniflow), normal regeneration is not possible, but thermal economization and storage are practical for the rotary engine version. Economization is possible by extending the heating and cooling means to the expansion and contraction halves of the cylinders. Heat storage is useful by placing a sealed housing containing a thermally active chemical directly over the hot manifold to provide long heat residence and containment.

Because of the establishment of a thermal potential across each cylinder, the gas flow will be from the hot to the cold side of each cylinder with the working gas, -(helium or hydrogen) being uniformly and alternately heated and cooled in series as it flows from unit cylinder to cylinder.

The multiple uniform small transfer tubing will be formed in a relatively large single or double top loop so that a sufficiently effective heat transfer means is maintained for both the heating and cooling sources. It is preferrable that a double, -heart-shaped loop(s) be formed for slightly more thermal separation between the hot and cold sources.

An enclosed heater shell covers the hot-half portion of the multiple small transfer tubes, with multiple burners providing the required heat flow over the hot-half portion of the transfer tubing.

A common heating shell may be provided for all of the modules, or each module may have its own heating shell depending on the overall length of the engine system assembly.

A combined liquid and air cooling means must be utilized for the cold-half portion of the multiple small transfer tubes. Several small liquid coolant tubing lines will be in tangent contact with each transfer tube, with uniformly placed cooling fins assembled over the combined tubing, which also serves to fasten the tubing lines together.

Forced air cooling may also be provided over the tubing lines by means of one or several powered fans.

An inconsistancy is connecting the hot side of one cylinder unit diagonally across to an adjacent unit is that the hot side of the last unit must be connected to the cold side of the first unit over the entire length of the engine assembly.

In order to obtain uniform length and thermal transfer for all the tubing runs, the last-to-the-first unit tubing array will not follow the high double loop pattern of the majority of units but be nearly linear and closer to the engine assembly.

The last-to-first unit tubing must pass through the heating shell volume of several units, then cross directly over to the cooling portion of an equal number of units, in order to achieve an equivalent thermal transfer flow.

The identical hot and cold manifolds should be easily removable from the unit cylinders so that the small transfer tubes, burner shell(s) and cooling tubes may be grouped as a unit assembly.

A variable pressure reservoir will be required as a means of repidly varying the power output of the engine system on demand.

The units or modules will be axially connected by splined or flexible couplings, with a front drive shaft and rear accessory shaft provided. Each unit will be secured to the adjacent unit with four, -or more outer spacers to insure proper alignment.

A dynamo will be connected to the rear shaft extension for alternately starting the engine, and for electric power for auxiliaries during normal engine operation.

The electrolysis unit for hydrogen production will be a simplified type of semi-enclosed tank with a rapid electrode control means, as described in Disclosure Document No. 022049, "Hydrogen Production Process, with Rapid Flow Control Means."

The use of a wind-driven generator in conjunction with the electrolysis offers the attractive feature of a fully independant electrical power system for any application including home and small industrial electrical power requirements.

In order to avoid the possibility of a dangerous accumulation of hydrogen gas, the electrolysis unit can automatically stop the electrolysis process by the fast removal of all electrode tubes from the caustic electrolyte.

The electrode tubes are all mounted on a controllable elevator plate which moves all electrode tubes up or down into the electrolyte as a unit assembly.

It is a principle object of the invention to produce a rotary closed series cycle engine system which converts heat energy into mechanical power, at the best possible cost/effectiveness ratio.

It is a prime objective of the invention to create a power system which may be fueled by sources other than petroleum base fuels.

All other objectives of the invention have been previously defined in the background and summary descriptions of the specifications.

It should be understood that variations may be made in the detail design of the rotary engine system, without departing from the spirit and scope of the invention, as specified.

A Disclosure Document No. 018274, has been filed in the Office which essentially describes this rotary closed cycle engine, and now forms a part of the specifications.

The following issued U.S. patents also contain design features which are pertinent to this present invention:-

1.) U.S. Pat. No. 3,370,418 — Rotary Stirling Cycle Engine
2.) U.S. Pat. No. 3,492,818 — Rotary Stirling Cycle Engine
3.) U.S. Pat. No. 3,488,945 — Rotary Stirling Cycle Engine.
4.) U.S. Pat. No. 3,537,256 — Rotary Stirling Engine.

DESCRIPTION OF THE PREFERRED EMBODIMENT

Figure 1:
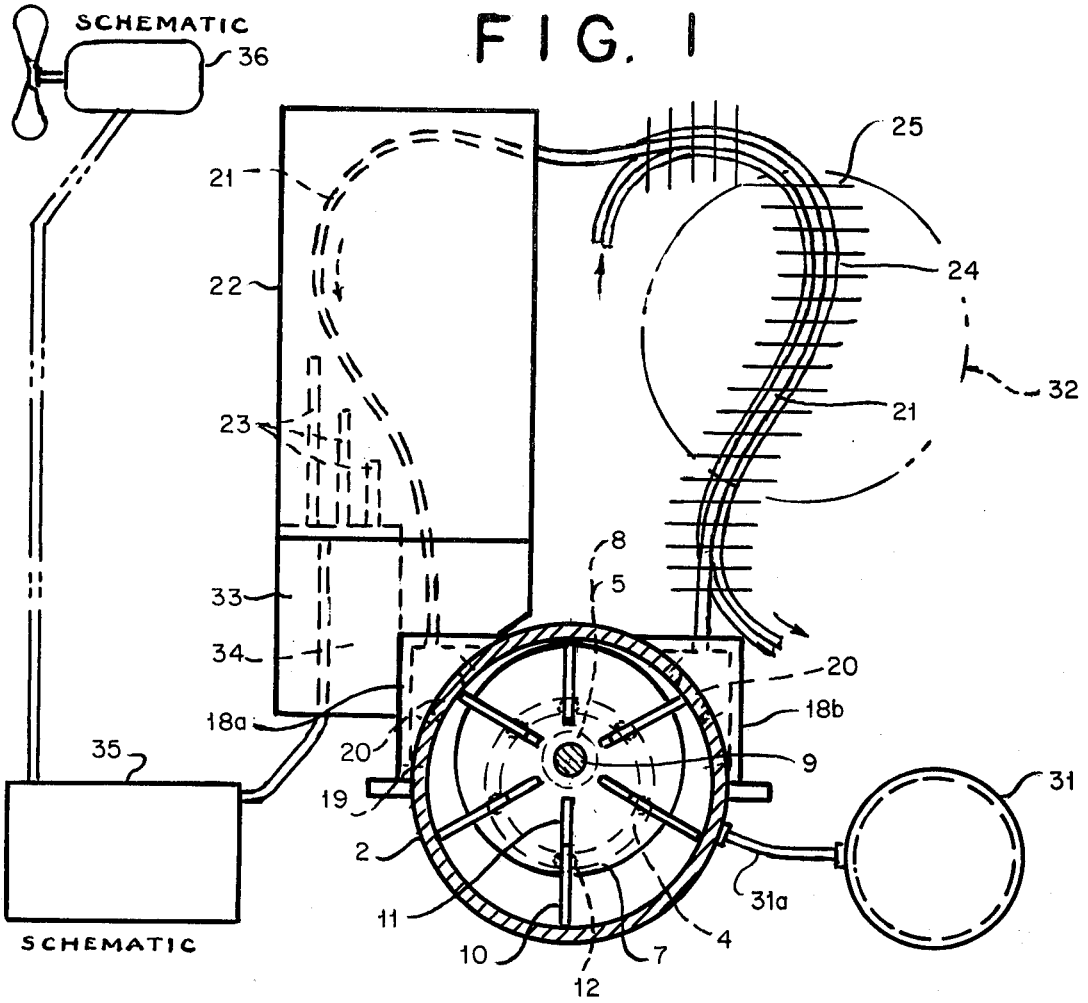
FIG. 1. is a front sectional view through the rotary closed series cycle engine system.
Figure 2:
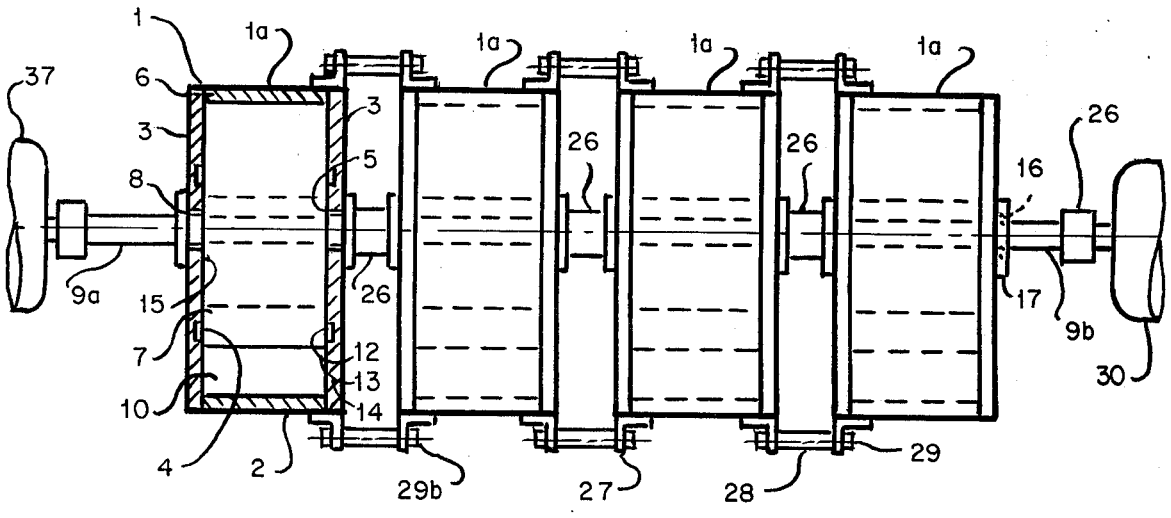
FIG. 2. is a side view of the assembled rotary closed series cycle engine system.
Figure 3:
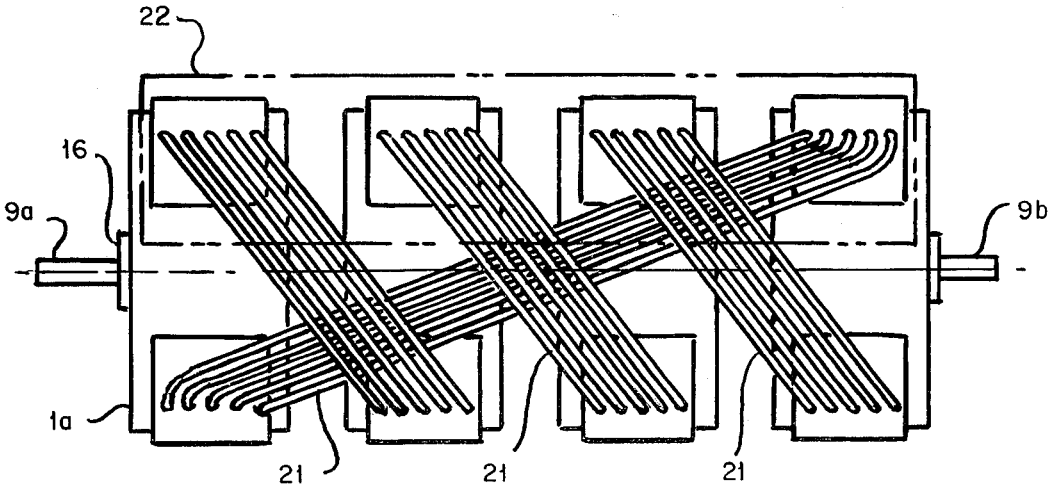
FIG. 3. is a top view of the assembled rotary closed series cycle engine system.
Figure 4:
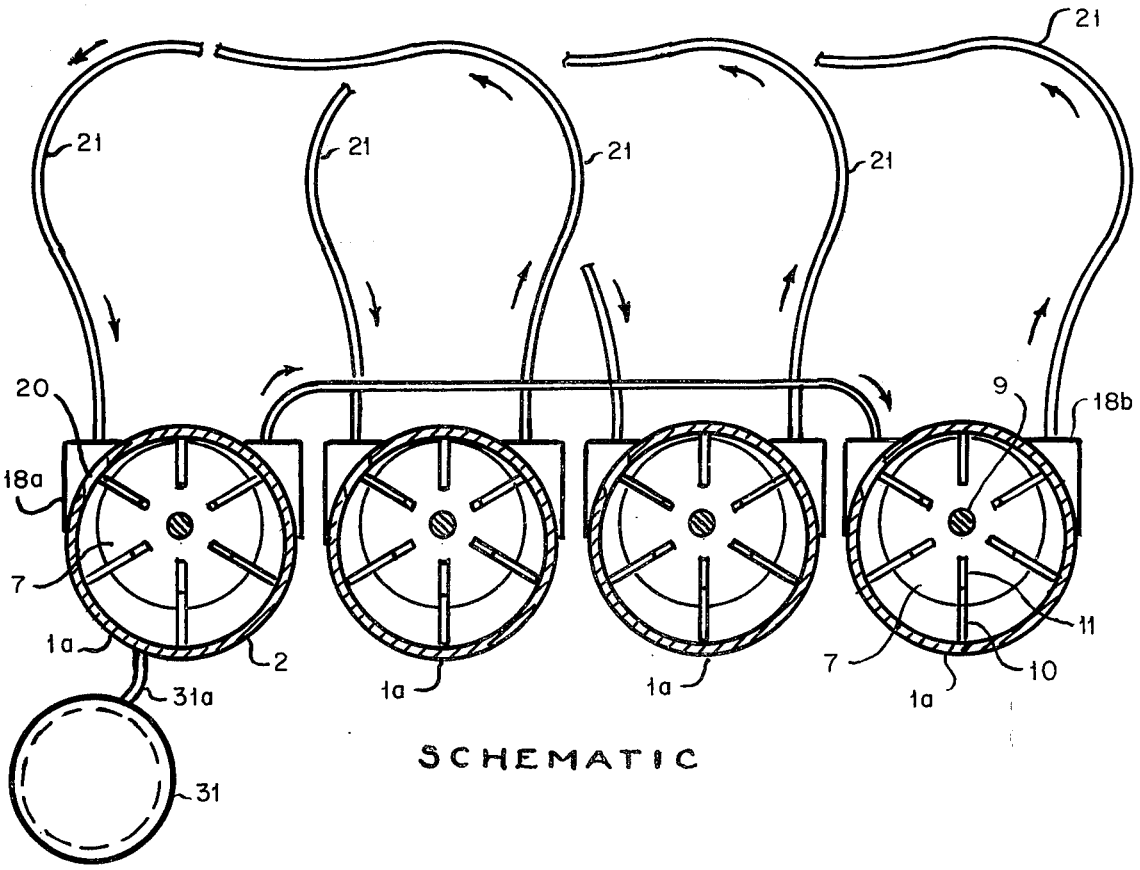
FIG. 4. is a schematic front view of each rotary unit or module showing the external transfer tubing connections.

The rotary closed series cycle engine assembly 1, is made up of individual rotary units or modules 1*a,* which are axially connected together to provide a total power output system.

Each unit 1*a,* is comprised of a true cylindrical housing 2, and two identical end plates 3.

The end plates 3, are provided with concentric internal circular grooves 4, which serve as tracks for rolling ball bearings on each vane. The plates also contain an identical eccentric bearing bore 5, along with fastening holes 6, uniformly located around the periphery of the end plates 3.

Each unit 1*a,* contains a close fitting, freely revolving slotted rotor 7, which is supported by two needle bearings 8, located within the bearing bores 5, by means of the drive shaft 9.

Multiple, identical hollow vanes 10, are uniformly fitted into corresponding slots 11, within the slotted rotor 7. Two identical ball bearings 12, are located in-line, at the sides of each vane 10, and secured to the vanes by the pins 13, and set screws 14.

Each ball bearing 12, is in rolling contact with the circular grooves 4, so that the multiple vanes 10, are guided with limited radial travel as the rotor 7, revolves within the cylinder housing 2.

Thin, low-friction spacers 15, are provided between the rotor 7, and the two identical end plates 3, which are positioned on the drive shaft 9.

The side clearance for each vane 10, is maintained by the close fitting ball bearings 12, in relation to the face of the circular grooves 4.

Gas pressure seals 16, are located within sealing plates 17, which are secured to the outsides of the two identical end plates 3.

Two identical manifolds 18, are secured at the upper sides of the cylindrical housing 2, with the screws 19. Rectangular ports 20, are located within the upper sides of the cylindrical housing 2, which exactly line up with the two identical manifolds 18.

Multiple small transfer tubes 21, connect the hot side manifold 18*a,* with the cold side manifold 18*b,* of an adjacent rotary unit 1*a.*

A burner housing 22, is provided for the unit cylindrical housing 2, which is connected to the top surface of the hot manifold 18*a.* Multiple burners 23, are secured within the burner housing 22, to provide the necessary heat flow for the transfer tubes 21.

Cooling tubes 24, are in close contact with the cold side of the transfer tubes 21, along with multiple flat fins 25, which secure the cooling tubes 24, to the transfer tubes 21.

A cooling fan(s) 32, is provided for additional forced air flow over the multiple flat fins 25.

The hot and cold manifolds 18*a* and 18*b* respectively, with the transfer tubes 21, cooling tubes 24, multiple fins 25, and burner housing 22, may be made up as one assembly for ease of handling.

A variable pressure reservoir 31, is utilized for rapidly varying the working pressure of the helium/hydrogen gas, on demand. A pressure line 31*a*, connects the reservoir 31, with one of the rotary units 1*a*.

A heat storage housing 33, containing a heat storage chemical 34, is located directly over the hot manifold 18*a*, for heating saturation and containment.

The units or modules 1*a*, are axially joined together at the output shafts 9, by flexible couplings or splines 26, with shaft extensions 9*a* and 9*b*, for the front and rear rotary units, respectively.

Four or more outer brackets 27, are secured to the outer, end surfaces of the cylindrical housing 2, which position the spacers 28, for joining each rotary unit 1*a*. Mounting screws 29, and nuts 29*b*, connect the spacers 28 to the brackets 27.

A dynamo 30, is connected to the rear shaft extension 9*b*, for starting the engine, and for some electrical power requirements.

The hydrogen gas fuel for the burners of the system is obtained from the electrolysis unit 35, on a continuous, demand basis. A hydrogen flow tube(s) connects the electrolysis unit 35, with the burners 23, of the engine system.

A wind-driven D.C. electric generator 36, will generate the necessary low voltage D.C. electrical power for the continuous electrolysis process.

What is claimed is:

1. A rotary closed series cycle engine comprising multiple indentical rotary units consisting of rotors and vanes revolving within cylindrical housings, two identical end plates secured to the ends of said cylindrical housings including concentric circular grooves uniformly disposed on the inside faces of said end plates, a uniformly slotted rotor eccentrically and tangentially disposed within said cylindrical housing, multiple flat and hollow rectangular vanes in sliding communication with the slots of said uniformly slotted rotor, multiple ball bearings secured to each side of said multiple flat and hollow rectangular vanes by means of multiple cylindrical pins, said multiple ball bearings are in rolling contact with said concentric circular grooves uniformly disposed on the inside faces of said end plates, two low-friction discs disposed on either side of said uniformly slotted rotor between said two identical end plates, a drive shaft concentrically disposed through said uniformly slotted rotor supported by two needle bearings eccentrically disposed within each of said two identical end plates, multiple gas pressure seals disposed on the outer faces of each of said two identical end plates over said drive shaft, four outer mounting brackets secured to the outer surface and ends of said cylindrical housing, four spacers disposed adjacent to said four outer mounting brackets fastened by four mounting screws and nuts, standard fastening and sealing means utilized for joining and securing components of said rotary closed series cycle engine, identical gas flow manifolds secured at the sides of said cylindrical housings, two rectangular ports disposed at the upper sides of said cylindrical housings in direct communication with said gas flow manifolds, multiple small diameter transfer tubing connected from one lateral group of said gas flow manifolds to the opposite lateral group of gas flow manifolds on adjacent rotary units of said rotary closed series cycle engine, joining and sealing means for said gas flow manifolds to said cylindrical housings, joining and sealing means for said multiple small diameter transfer tubing to said gas flow manifolds.

* * * * *